US010118064B1

(12) United States Patent
Cox

(10) Patent No.: US 10,118,064 B1
(45) Date of Patent: Nov. 6, 2018

(54) ADJUSTABLE ISOMETRIC EXERCISE APPARATUS

(71) Applicant: William T. Cox, Taylor, AZ (US)

(72) Inventor: William T. Cox, Taylor, AZ (US)

( * ) Notice: Subject to any disclaimer, the term of this patent is extended or adjusted under 35 U.S.C. 154(b) by 319 days.

(21) Appl. No.: 15/062,381

(22) Filed: Mar. 7, 2016

(51) Int. Cl.

| | |
|---|---|
| ***A63B 21/002*** | (2006.01) |
| ***A63B 22/02*** | (2006.01) |
| *A63B 26/00* | (2006.01) |
| *A63B 17/02* | (2006.01) |
| *A63B 23/035* | (2006.01) |
| *A63B 3/00* | (2006.01) |
| *A63B 1/00* | (2006.01) |
| *A63B 17/00* | (2006.01) |
| *A63B 17/04* | (2006.01) |
| *A63B 71/02* | (2006.01) |

(52) U.S. Cl.

CPC ..... *A63B 21/0023* (2013.01); *A63B 22/02* (2013.01); *A63B 1/00* (2013.01); *A63B 3/00* (2013.01); *A63B 17/00* (2013.01); *A63B 17/02* (2013.01); *A63B 17/04* (2013.01); *A63B 23/0355* (2013.01); *A63B 23/03558* (2013.01); *A63B 26/00* (2013.01); *A63B 26/003* (2013.01); *A63B 71/023* (2013.01); *A63B 71/028* (2013.01); *A63B 2026/006* (2013.01); *A63B 2071/024* (2013.01)

(58) Field of Classification Search

CPC .. A63B 1/00; A63B 3/00; A63B 17/00; A63B 17/02; A63B 17/04; A63B 21/0023; A63B 22/02; A63B 23/0355; A63B 23/03558; A63B 26/00; A63B 26/003; A63B 2026/006

See application file for complete search history.

(56) References Cited

U.S. PATENT DOCUMENTS

| | | | | | |
|---|---|---|---|---|---|
| 931,394 | A | * | 8/1909 | Day | A63B 22/02 482/54 |
| 1,116,229 | A | * | 11/1914 | Boone | A63B 1/00 482/38 |
| 3,193,287 | A | * | 7/1965 | Robinson | A63B 22/02 482/54 |
| 3,397,884 | A | | 8/1968 | Blasi | |
| 3,424,005 | A | | 1/1969 | Brown | |
| 4,607,841 | A | | 8/1986 | Gala | |
| 4,869,493 | A | * | 9/1989 | Johnston | A63B 22/0002 482/114 |
| 5,156,580 | A | | 10/1992 | Holland et al. | |
| 5,162,029 | A | * | 11/1992 | Gerard | A63B 22/02 198/861.1 |
| 5,356,362 | A | * | 10/1994 | Becker | A63B 23/0488 482/133 |

(Continued)

*Primary Examiner* — Joshua Lee

(74) *Attorney, Agent, or Firm* — Cramer Patent & Design, PLLC; Aaron R. Cramer

(57) ABSTRACT

An isometric exercise apparatus adaptable to an existing treadmill or similarly shaped platform provides a height-adjustable bar assembly and rigid supporting pole portions. The horizontal bar is vertically adjustable by selectively unclamping and sliding the bar along the vertical bars. The apparatus may be adjusted and secured in various positions for singular or combined use with the treadmill. The mounting means of the apparatus to frame portions of the treadmill allows for easy disassembly and storage of the apparatus in a closet or under a bed.

2 Claims, 5 Drawing Sheets

(56) References Cited

U.S. PATENT DOCUMENTS

| | | | | | |
|---|---|---|---|---|---|
| 5,385,520 | A * | 1/1995 | Lepine | A63B 22/0023 | 482/51 |
| 5,538,487 | A | 7/1996 | Fulmer | | |
| 5,586,961 | A * | 12/1996 | Quint | A63B 22/02 | 482/111 |
| 5,776,037 | A | 7/1998 | Millington | | |
| 5,873,798 | A * | 2/1999 | Bostick | A63B 69/0084 | 473/426 |
| 5,941,800 | A * | 8/1999 | Laconis | A63B 69/18 | 482/51 |
| 6,024,657 | A * | 2/2000 | Bettencourt, Jr. | A63B 69/0079 | 473/427 |
| 6,409,640 | B2 | 6/2002 | Cournoyer | | |
| 6,699,162 | B2 | 3/2004 | Chen | | |
| 7,137,937 | B2 | 11/2006 | Croft | | |
| 7,736,286 | B2 * | 6/2010 | Panaiotov | A63B 21/16 | 482/121 |
| 8,057,371 | B2 * | 11/2011 | McBride | A63B 1/00 | 482/121 |
| 9,370,680 | B1 * | 6/2016 | Macaulay | A63B 21/0552 | |
| 2006/0003877 | A1 * | 1/2006 | Harmon | A63B 21/0023 | 482/142 |
| 2009/0023566 | A1 * | 1/2009 | Florczak | A63B 1/00 | 482/142 |

* cited by examiner

ADJUSTABLE ISOMETRIC EXERCISE APPARATUS

RELATED APPLICATIONS

The present invention was first described in and claims the benefit of U.S. Provisional Application No. 62/130,896, filed Mar. 10, 2015, the entire disclosures of which are incorporated herein by reference.

FIELD OF THE INVENTION

The present invention relates generally to an isometric exercise apparatus adaptable to an existing treadmill or similarly shaped platform.

BACKGROUND OF THE INVENTION

Improved physical fitness and general healthy living are among some of the highest areas of concern among Americans today. More than ever, people are frequenting health clubs and performing exercise routines at home in order to lose weight, improve muscle tone, and maintain a healthy cardiovascular system. To this end, some people employ the use of isometric exercises as part of their overall health regime.

Simply understood, isometric exercises are exercises in which an individual applies a force to an immovable object for a specified period of time. While the physically fit may often employ the use of isometric exercises, others turn to isometric exercises out of necessity as part of physical therapy following an injury, surgery or physical incapacity due to age. While there are many types of exercise machines, many of these machines which are specifically designed for isometric exercise use are specifically designed for use for one (1) particular exercise and one particular exercise only. Additionally, oftentimes these exercise machines have a cost or space requirements which make them impractical for many locations.

Accordingly, there exists a need for a means by which one can engage in isometric style exercises without the disadvantages as described above. The use of the exercise apparatus allows users the ability to maximize their isometric exercise workout in an efficient, yet efficacious, manner for the purposes of either athletic training or physical rehabilitation.

SUMMARY OF THE INVENTION

The inventor has recognized the aforementioned inherent problems and lack in the art and observed that there is a need for an isometric exercise apparatus adaptable to an existing treadmill or similarly shaped platform.

It is therefore the purpose of the inventor to provide an exercise apparatus, comprising a baseplate which has a first coupling that is secured to a first distal end of a top side of the baseplate and a second coupling that is secured to an opposite second distal end of the top side of the baseplate, a first pole which has a first lower end that is removably affixed to the first coupling; a second pole that has a second lower end that is removably affixed to the second coupling and a bar which is removably affixed to and spans the distance between the first pole and the second pole. The baseplate is capable of being placed under a treadmill or a platform such that the first and second coupling each extends beyond both of the opposing sides of the treadmill or platform. The first and second pole are also oriented in a parallel manner to each other and are perpendicular to the baseplate.

The first and second coupling may also have an interior female thread portion while the first and second lower ends of the first and second poles may have an exterior male threaded portion. As a result, the first coupling is capable of being threadingly secured to the first lower end of the first pole and the second coupling is capable of being threadingly secured to the second lower end of the second pole.

The bar may also comprise a pole fitting which has a horizontally oriented pole aperture at each of the pole fitting's distal ends and a lock bolt capable of securing each pole fitting about a respective pole. The pole fitting securely slides around a diameter of a respective pole and has a lock bolt aperture located through a distal end of each pole fitting.

The baseplate may also comprise at least one (1) clamp bar which is capable of being secured perpendicularly beneath the baseplate which also may have a fastener aperture located at each first distal end and a "U" bolt which is capable of being secured to the clamp bar distal ends. The clamp bar is capable of being positioned under the baseplate so that each fastener aperture extends beyond both opposing sides of the baseplate. Each "U" bolt is also capable of being secured over a frame member of the treadmill.

The coupling may be welded to the baseplate. A gripping surface may be provided which circumscribes at least a center portion of the bar. A gripping surface may also be provided which circumscribes at least a center portion of the first and second poles. The poles may be made of solid metal or metal tubing.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
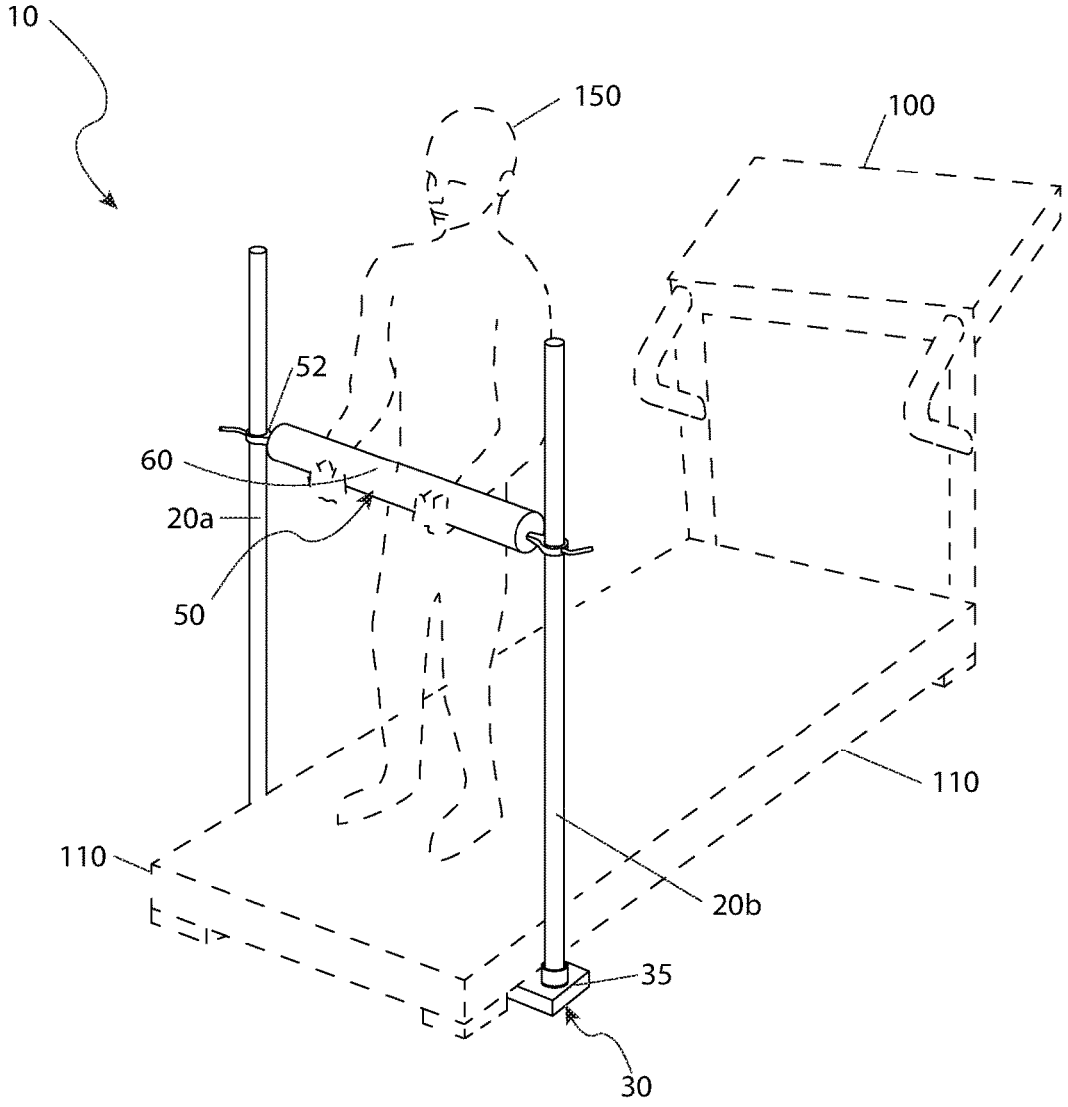
FIG. 1 is an environmental view of an isometric exercise apparatus 10 depicted being mounted to a treadmill 100, according to a preferred embodiment of the present invention.
Figure 2:
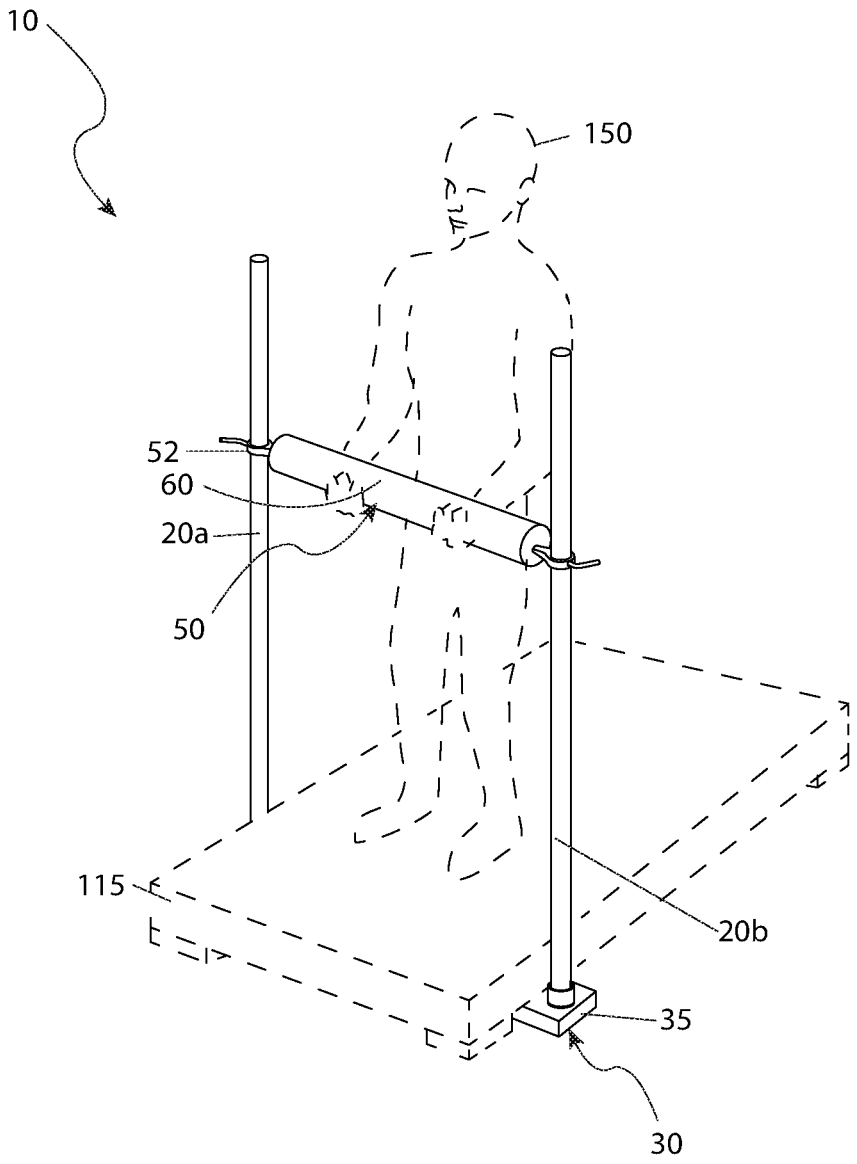
FIG. 2 is another environmental view of an isometric exercise apparatus 10 depicting being mounted to a platform 115, according to a preferred embodiment of the present invention.

10 isometric exercise apparatus
20*a* first pole
20*b* second pole
22 male threaded region
30 baseplate assembly
35 baseplate

40*a* first coupling
40*b* second coupling
42 female threaded region
44 weld
50 bar assembly
52 bar
54*a* first pole fitting
54*b* second post fitting
56 post aperture
58 lock bolt aperture
60 gripping surface
62*a* first lock bolt
62*b* second lock bolt
65 side padding
80 "U"-bolt
82 fastener aperture
83*a* first clamp bar
83*b* second clamp bar
84 nut fastener
100 treadmill
110 treadmill base
115 platform structure
120 frame member
150 user

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an isometric exercise apparatus (herein described as the "apparatus") 10, which provides an exercise aid preferably designed for mounting to an existing treadmill 100, or similar platform structure 115, to enable a user 150 to perform various isometric exercises.

Referring now to FIGS. 1, 2, 3, and 4, environmental and exploded views of the apparatus 10, according to the preferred embodiment of the present invention, are disclosed. The apparatus 10 provides an overall "H"-shaped structure made up of vertical and parallel first pole 20*a* and second pole 20*b* portions, and a removably attached and adjustable bar assembly 50 affixed there between. The apparatus 10 is approximately five to six feet (5-6 ft.) in height and thirty to thirty-six (30-36 in.) inches in width.

The posts 20*a*, 20*b* are made of solid or hollow metal rod-shapes having bottom end male threaded regions 22 which provide threaded attachment to a subjacent horizontal baseplate assembly 30 which extends perpendicularly between the posts 20*a*, 20*b*, and beneath the treadmill 100. Each male threaded region 22 of the posts 20*a*, 20*b* threadingly engages corresponding female threaded region portions 42 of respective first coupling 40*a* and second coupling 40*b* portions which are welded 44 to a top surface of a baseplate portion 35 of the baseplate assembly 30. The baseplate 35 acts to rigidly maintain the vertical and parallel orientation of the posts 20*a*, 20*b*. The baseplate 35 provides a rectangular metal plate structure which is positioned beneath, and extends outwardly from, both side portions of the treadmill base 110. The outwardly extending portions of the baseplate 35 include the couplings 40*a*, 40*b*, thereby positioning the threadingly attached posts 20*a*, 20*b* alongside portions of the treadmill base 110. The baseplate 35 is envisioned to be rigidly affixed to internal frame member portions 120 of the treadmill base 110 using a pair of "U"-bolts 80 and corresponding first clamp bar 83*a* and second clamp bar 83*b* portions being affixed thereto the "U"-bolts 80. The clamp bars 83*a*, 83*b* include integral fastener apertures 82, allowing insertion of the "U"-bolts 80 therethrough, which are then secured to the frame members 120 using nut fasteners 84 (also see FIG. 5).

The posts 20*a*, 20*b* and baseplate assembly 30 are sized so as to be easily affixed and utilized with an existing treadmill 100, or may be affixed to, and utilized in conjunction with various similarly shaped platforms 115. It is envisioned that the platform 15 may be different lengths so as to facilitate standing, sitting, and laying down positions of the user 150 to perform corresponding exercises.

The center bar assembly 50 is made up of an elongated solid or hollow linear metal bar portion 52 having integral "donut-shaped" first pole fitting 54*a* and second pole fitting 24*b* portions at each opposing end. Each pole fitting 54*a*, 54*b* in turn includes a respective pole aperture 56 which enables sliding insertion and adjustable vertical positioning of the bar assembly 50 upon the poles 20*a*, 20*b* in a coincidental manner. Each pole fitting 54*a*, 54*b* further includes a threaded lock bolt aperture 58 capable of threadingly receiving respective first lock bolt 62*a* and second lock bolt 62*b* portions. An embodiment of the lock bolts 62*a*, 62*b* is shown here having an "L"-shape so as to provide effective hand-tightening thereof. Each lock bolt 62*a*, 62*b* threadingly passes through the lock bolt aperture 58 and subsequently bears against, and clamps the inserted posts 20*a*, 20*b* within.

It is envisioned that the bar assembly 50 may be adjusted vertically so as to aid in various arm and shoulder exercises, as well as be positioned slightly above the surface of the treadmill 100 to perform sit-up-type exercises, if desired.

Figure 3:
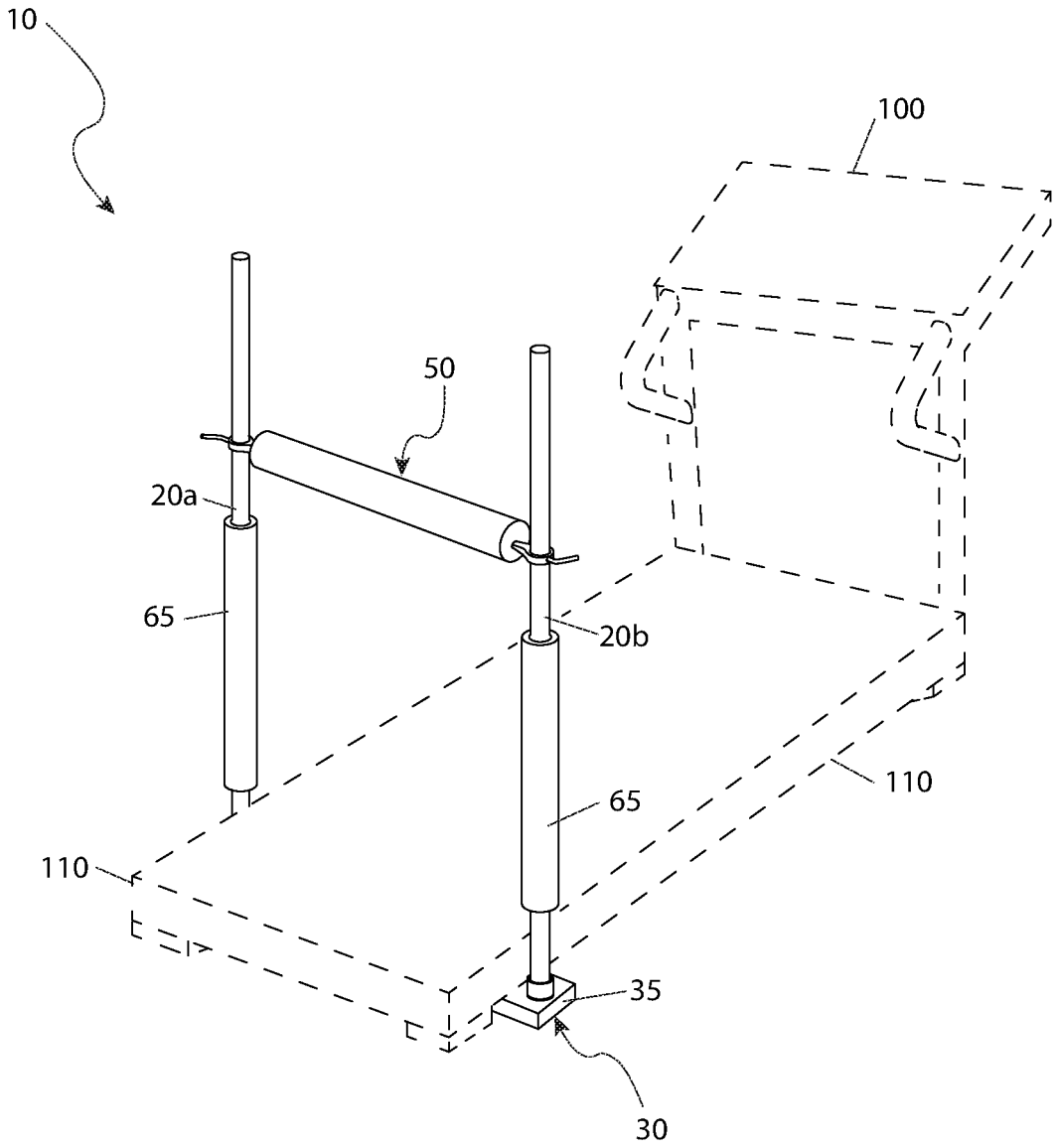
FIG. 3 is yet another environmental view of the isometric exercise apparatus 10 depicting side padding portions 65, according to a preferred embodiment of the present invention.
Figure 4:
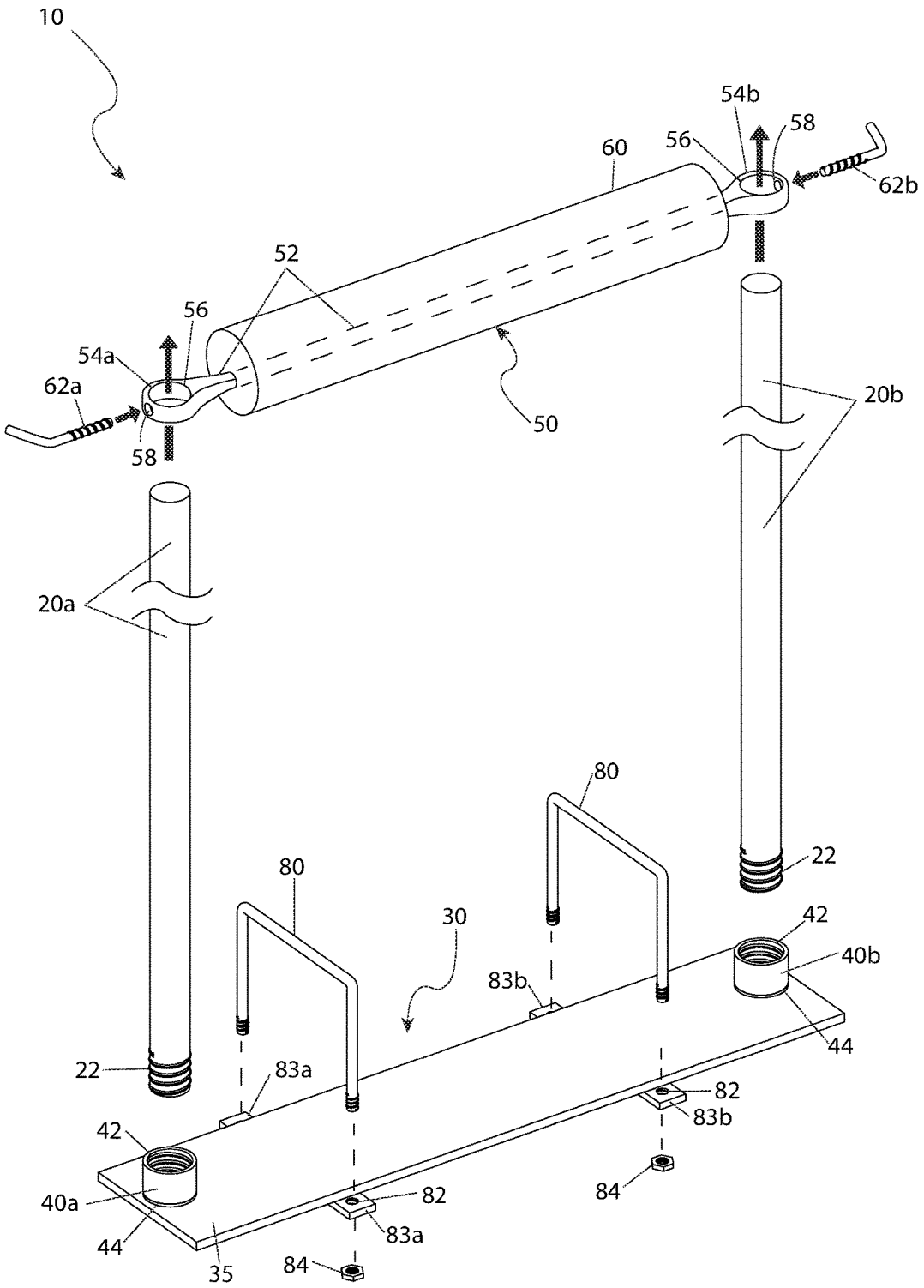
FIG. 4 is an exploded view of the isometric exercise apparatus 10, according to a preferred embodiment of the present invention; and, FIG. 5 is a bottom perspective view of the isometric exercise apparatus 10 depicting attachment of a baseplate assembly portion 30, according to a preferred embodiment of the present invention.

The bar assembly 50 further includes a cylindrical gripping surface 60 which covers a primary surface portion of the bar 52. The gripping surface 60 is envisioned to be made using comfortable and high-friction materials to improve a user's 150 grip such as a dense urethane or polystyrene foam sleeve. It is understood that the gripping surface 60 may also provide a vinyl covering, a cylindrical coating of high-friction plastic or rubber, or the like, without being interpreted as a limitation of scope. The apparatus 10 is shown in FIG. 3 having side padding portions 65 installed around the poles 20*a*, 20*b* to provide additional protection while performing other exercises. It is envisioned that the apparatus 10 may be introduced having removable gripping surface 60 and side padding 65 portions, having longitudinal slits therethrough, to provide easy removal.

It is preferred that the apparatus 10 be mounted to a rearward portion of an existing treadmill 100, and mechanically attached to opposing internal frame members 120 thereof; however, it is understood that other stable low-profile platform-like structures 115 which provide similar frame attachment means may also be utilized if desired, and as such should not be interpreted as a limiting factor of the apparatus 10.

Figure 5:
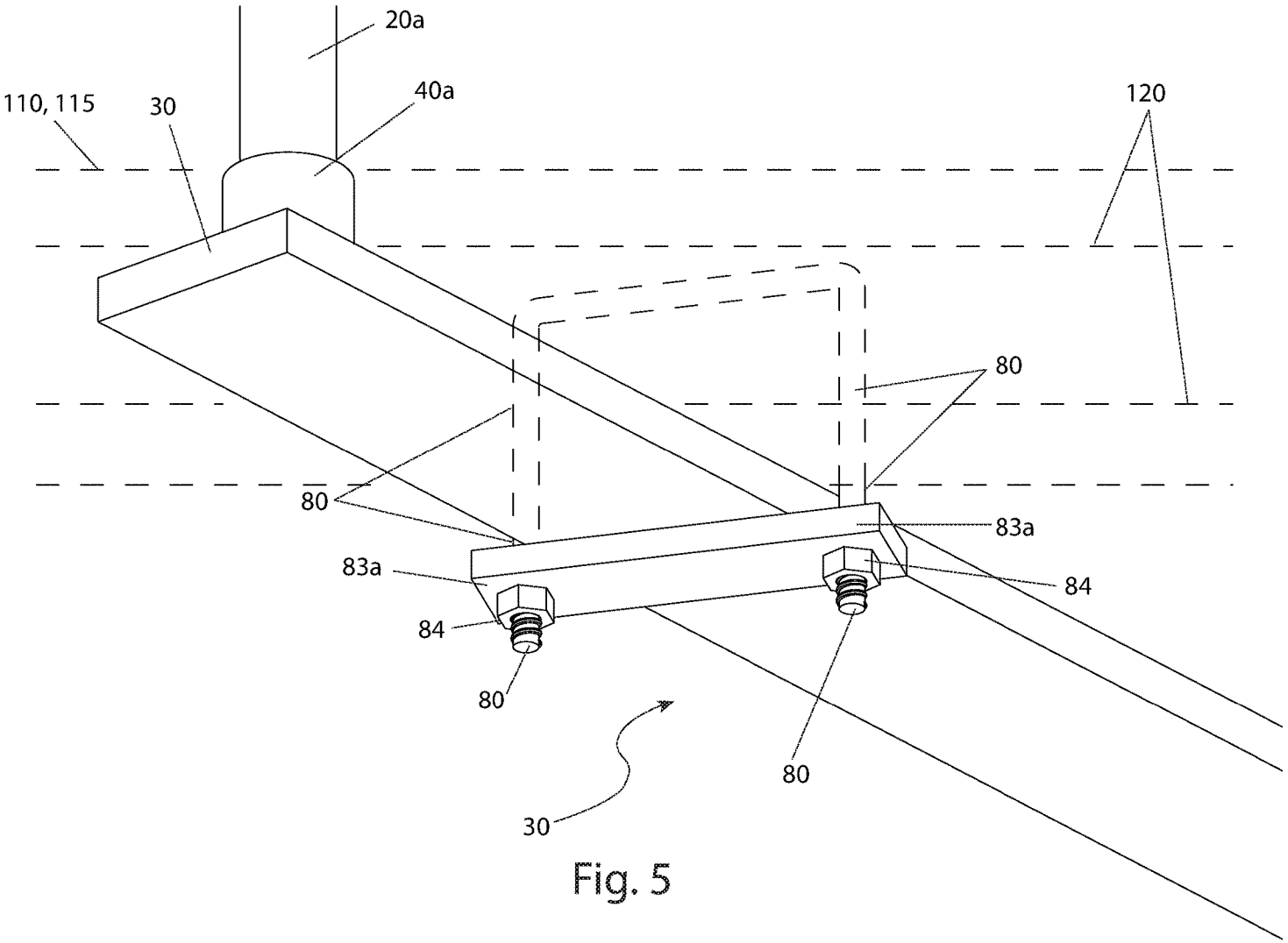

Referring now to FIG. 5, a bottom perspective view of the apparatus 10 depicting attachment of a baseplate assembly portion 30, according to a preferred embodiment of the present invention, is disclosed. The apparatus 10 is shown here being secured to a frame member portion 120 of the existing treadmill 100 by positioning the "U"-bolt 80 and corresponding clamp bar 83*a* in a diagonal manner around the frame member 120 and alongside portions of baseplate 35, and being secured by installing and tightening a nut fastener 84.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 having sufficient width such that the baseplate 35 extends outwardly from the treadmill base 110 to position the couplings 40*a*, 40*b* beside the treadmill base 110; positioning the baseplate 35 against bottom surfaces of the frame members 120 of the treadmill 100; positioning the "U"-bolts 80 around both the baseplate 35 and frame members 120 of the treadmill base 110; securing the baseplate assembly 30 to the frame members 120 by inserting the fastener aperture portions 82 of the clamp plates 83*a*, 83*b* onto the "U"-bolts 80, and installing and tightening the nut fasteners 84; engaging and rotating the poles 20*a*, 20*b* into respective threaded coupling portions 40*a*, 40*b* until tightened to rigidly position the poles 20*a*, 20*b*; inserting top end portions of the poles 20*a*, 20*b* into the post aperture portions 56 of the bar assembly 50; sliding the bar assembly 50 upward or downward until obtaining a desired height; securing the bar assembly 50 in position by manually rotating the lock bolts 62*a*, 62*b* until clamping against the posts 20*a*, 20*b*; utilizing the apparatus 10 to perform isometric exercises as desired; performing additional exercises as desired, while adjusting the height of the bar assembly 50 as needed; disassembling the apparatus 10 when finished exercising by loosening the lock bolts 62*a*, 62*b* and removing the bar assembly 50; extracting the posts 20*a*, 20*b* from the couplings 40*a*, 40*b*; detaching the baseplate 35 from the frame members 120 of the treadmill 100, if desired, by removing the nut fasteners 84, the clamp bars 83*a*, 83*b*, and the "U"-bolts 80; storing the posts 20*a*, 20*b*, bar assembly 50, and baseplate 35 portions compactly in a closet or under a bed; and, benefiting from convenient adaptation of an existing treadmill 100 or similar platform structure 115 to perform various isometric and other exercises, afforded a user 150 if the present invention 10.

With the bar assembly 50 near the bottom of the posts 20*a*, 20*b*, isometric exercises using a user's 150 feet or legs can be performed. Additionally, the bar assembly 50 may serve as a brace while performing sit-ups. With the bar assembly 50 at an upper position, the apparatus 10 may be used to perform isometric exercises using one's arms, shoulders, and neck. It is further envisioned that a user 150 may be further aided during exercises by using a metronome device to help count off time while doing each exercise.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An exercise apparatus, comprising:

a baseplate having a first coupling secured to a first distal end of a top side thereof, and a second coupling secured to an opposite second distal end of said top side thereof, said baseplate comprising:

at least one clamp bar capable of being secured perpendicularly beneath said baseplate, said at least one clamp bar further having a fastener aperture located at each first distal end of said baseplate; and a "U" bolt capable of securing to a clamp bar first distal end and a clamp bar second distal end;

a first pole having a first lower end removably affixed to said first coupling;

a second pole having a second lower end removably affixed to said second coupling; and a bar removably affixed to and spanning a distance between said first pole and said second pole;

wherein said baseplate is capable of being placed under a treadmill such that said first coupling and said second coupling each extends beyond both opposing sides of said treadmill;

wherein said first pole and said second pole are oriented in a parallel manner to each other and perpendicular to said baseplate;

wherein each said clamp bar is positioned under said baseplate such that each said fastener aperture thereof each extends beyond both opposing sides of said baseplate; and wherein each said "U" bolt is secured over a frame member of said treadmill.

2. An exercise apparatus, comprising:

a baseplate having a first coupling secured to a first distal end of a top side thereof, and a second coupling secured to an opposite second distal end thereof, said baseplate comprising:

at least one clamp bar capable of being secured perpendicularly beneath said baseplate, said at least one clamp bar further having a fastener aperture located at each first distal end of said baseplate; and a "U" bolt capable of securing to a clamp bar first distal end and a clamp bar second distal end;

a first pole having a first lower end removably affixed to said first coupling;

a second pole having a second lower end removably affixed to said second coupling; and a bar removably affixed to and spanning a distance between said first pole and said second pole;

wherein said baseplate is capable of being placed under a platform such that said first coupling and said second coupling each extends beyond both opposing sides of said platform;

wherein said first pole and said second pole are oriented in a parallel manner to each other and perpendicular to said baseplate;

wherein each said clamp bar is positioned under said baseplate such that each said fastener aperture thereof each extends beyond both opposing sides of said baseplate; and wherein each said "U" bolt is secured over a frame member of said treadmill.

* * * * *